US010741922B2

(12) United States Patent
Shiba

(10) Patent No.: US 10,741,922 B2
(45) Date of Patent: Aug. 11, 2020

(54) WIRELESS COMMUNICATION MODULE AND METHOD OF MANUFACTURING WIRELESS COMMUNICATION MODULE

(71) Applicant: FUJITSU LIMITED, Kawasaki-shi, Kanagawa (JP)

(72) Inventor: Shoichi Shiba, Atsugi (JP)

(73) Assignee: FUJITSU LIMITED, Kawasaki (JP)

( * ) Notice: Subject to any disclaimer, the term of this patent is extended or adjusted under 35 U.S.C. 154(b) by 612 days.

(21) Appl. No.: 15/454,367

(22) Filed: Mar. 9, 2017

(65) Prior Publication Data

US 2017/0338566 A1 Nov. 23, 2017

(30) Foreign Application Priority Data

May 19, 2016 (JP) ..... 2016-100428

(51) Int. Cl.

| | |
|---|---|
| ***H01Q 13/02*** | (2006.01) |
| ***H01Q 1/48*** | (2006.01) |
| ***H01Q 1/22*** | (2006.01) |
| ***H01Q 9/04*** | (2006.01) |

(52) U.S. Cl.

CPC ..... *H01Q 13/02* (2013.01); *H01Q 1/2283* (2013.01); *H01Q 1/48* (2013.01); *H01Q 9/0485* (2013.01)

(58) Field of Classification Search

CPC ..... H01Q 1/2283; H01Q 13/02–13/04; H01P 3/121

See application file for complete search history.

(56) References Cited

U.S. PATENT DOCUMENTS

| | | | | |
|---|---|---|---|---|
| 6,061,026 | A | 5/2000 | Ochi et al. | |
| 8,604,991 | B2 * | 12/2013 | Nagayama | H01Q 21/064 343/772 |
| 2002/0149530 | A1 | 10/2002 | Ballantine et al. | |
| 2014/0239465 | A1 * | 8/2014 | Yen | H01L 23/66 257/659 |
| 2016/0006129 | A1 * | 1/2016 | Haziza | H01Q 13/02 343/783 |
| 2017/0324135 | A1 * | 11/2017 | Blech | H01P 3/121 |
| 2019/0057945 | A1 * | 2/2019 | Maaskant | H01P 3/121 |

FOREIGN PATENT DOCUMENTS

| | | | |
|---|---|---|---|
| JP | H10-224141 | A | 8/1998 |
| JP | 2002-353729 | A | 12/2002 |
| JP | 2013-247494 | A | 12/2013 |
| JP | 2014-179935 | A | 9/2014 |

* cited by examiner

*Primary Examiner* — Graham P Smith
*Assistant Examiner* — Amal Patel
(74) *Attorney, Agent, or Firm* — Fujitsu Patent Center

(57) ABSTRACT

A wireless communication module includes a horn antenna and a semiconductor chip, and the horn antenna and the semiconductor chip are integrally formed by a mold resin and are connected through a transmission line. The horn antenna includes an open end provided on a longitudinal end face of the wireless communication module; an antenna conversion unit located on an opposite side of the open end and connected with the semiconductor chip through the transmission line; and a side face part whose shape is varied in a thickness direction of the wireless communication module in a manner such that an opening area is widened from the antenna conversion unit toward the open end.

10 Claims, 6 Drawing Sheets

WIRELESS COMMUNICATION MODULE AND METHOD OF MANUFACTURING WIRELESS COMMUNICATION MODULE

CROSS-REFERENCE TO RELATED APPLICATION

This application is based upon and claims the benefit of priority of the prior Japanese Patent Application No. 2016-100428, filed on May 19, 2016, the entire contents of which are incorporated herein by reference.

FIELD

The embodiments discussed herein are related to a wireless communication module and a method of manufacturing wireless communication module.

BACKGROUND

In recent years, a wireless communication module has been used in a wireless communication device, a radar device, and an imaging device using a high-frequency electromagnetic wave (high frequency signal) in, for example, a millimeter wave band or higher. The wireless communication module includes, for example, a waveguide horn antenna (horn antenna) and a semiconductor chip (Monolithic Microwave Integrated Circuit (MMIC)).

For example, a horn antenna used in a wireless communication device or the like transmits and receives a high frequency signal, includes a truncated pyramidal (conical) metal waveguide whose port is tapered in a manner to be gradually widened, has good beam pattern controllability, and is capable of earning a high antenna gain. Note that the term "high frequency signal" herein includes, for example, a signal of a millimeter wave (wavelength from 1 mm to 10 mm: frequency from 30 GHz to 300 GHz), a sub-millimeter wave (1 mm or less: 300 GHz or more), and a terahertz wave (30 μm to 3 mm: 0.1 THz to 10 THz).

In a wireless communication module, for example, a high frequency signal transmitted and received by a horn antenna is processed by a semiconductor chip (MMIC). When a high frequency signal is input, for example, a propagation mode of the high frequency signal is converted from a signal for a horn antenna (waveguide) to a signal for a planar transmission line (microstrip line) and is input to a semiconductor chip. In addition, when a high frequency signal is output, for example, a signal from the semiconductor chip via the planar transmission line is converted into a propagation mode for a high frequency signal and is output from the horn antenna. In this manner, a wireless communication module (extremely high frequency band module) includes, mounted thereon, a horn antenna, an antenna conversion unit, a substrate for signal transmission and a semiconductor chip, for example.

In addition, it has been recently contemplated that a wireless communication module is mounted on a compact portable terminal such as a smartphone and a wearable device. However, since the wireless communication module includes a horn antenna, size reduction, in particular, thickness reduction is desired.

Specifically, for example, a wireless communication module with a thickness (height) of 1 mm or less is desired to be mounted on a smartphone or the like without deteriorating design flexibility. The problem in size is present not only when mounting a wireless communication module on a compact portable terminal such as a smartphone but also when applying a wireless communication module to various devices.

Incidentally, in the past, there have been proposed various wireless communication modules to which a waveguide horn antenna is applied.

Patent Document 1: Japanese Laid-open Patent Publication No. 2014-179935

Patent Document 2: Japanese Laid-open Patent Publication No. 2013-247494

Patent Document 3: Japanese Laid-open Patent Publication No. 1998(H10)-224141

Patent Document 4: Japanese Laid-open Patent Publication No. 2002-353729

SUMMARY

According to an aspect of the embodiments, there is provided a wireless communication module includes a horn antenna and a semiconductor chip, and the horn antenna and the semiconductor chip are integrally formed by a mold resin and are connected through a transmission line.

The horn antenna includes an open end provided on a longitudinal end face of the wireless communication module; an antenna conversion unit located on an opposite side of the open end and connected with the semiconductor chip through the transmission line; and a side face part whose shape is varied in a thickness direction of the wireless communication module in a manner such that an opening area is widened from the antenna conversion unit toward the open end.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Figure 1:
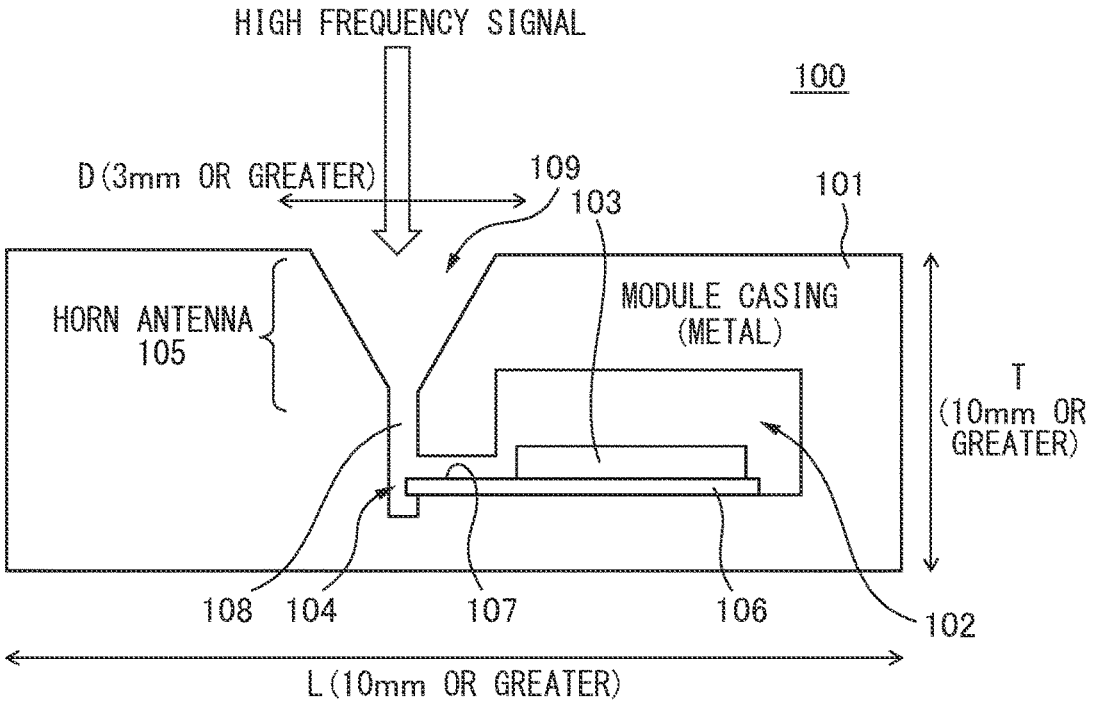
FIG. 1 is a diagram schematically illustrating an example of a wireless communication module.

First, before describing embodiments of a wireless communication module and a method of manufacturing the wireless communication module, an example of a wireless communication module and a problem thereof will be described with reference to FIG. 1. FIG. 1 is a diagram schematically illustrating an example of a wireless communication module, and illustrates an example of a wireless communication module (high frequency package) that receives a high frequency signal of around 300 GHz, for example.

As illustrated in FIG. 1, a wireless communication module 100 includes a horn antenna (waveguide horn antenna) 105 and a semiconductor chip (for example, a MMIC for communication) that are integrally formed by a module casing (metal) 101. The horn antenna 105 is formed in a pyramid (or cone) shape that is tapered in a manner to be gradually widened from a waveguide unit (lower part in FIG. 1) 108 toward an open end (upper face in FIG. 1) 109.

Inside the module casing 101, a cavity 102 is formed in which a transmission line substrate 106 and a semiconductor chip 103 mounted thereon are provided. In addition, at an end of the transmission line substrate 106, a transmission line (microstrip line) 107 is formed, where a conversion unit for mutually converting between a waveguide mode of the horn antenna 105 and a transmission mode of the microstrip line 107 is provided.

In the wireless communication module 100, as illustrated in FIG. 1, the open end 109 of the horn antenna 105 has a width D of around 3 mm, and the module casing 101 has a length L of around 10 mm and a thickness (height) T of around 10 mm, for example. Further, the module casing 101 has a width (depth-direction length in FIG. 1) of around 10 mm. Note that the wireless communication module 100 is mainly applied to various devices that use a high frequency signal, such as a wireless communication device, a radar device and an imaging device using a frequency of a millimeter wave band or higher.

By the way, data transmission using radio frequency has been recently used in various fields. For example, a short-range radio communication technology such as Near Field Communication (NFC) has spread widely and there are a variety of uses thereof. One of conceivable technical developments in the future is to improve a transmission rate and enable, for example, data transfer of a large volume of contents such as high-definition video. Examples of application of such a technique include a download system that allows a user to instantaneously acquire data by holding a user's own information terminal over a server arranged in a station kiosk, a convenience store and the like for distributing information such as movies, music, sports and news.

Conceivable examples of the user's information terminal include a compact portable terminal such as a smartphone and a wearable device. However, these compact portable terminals may impose strict restrictions on size of an electronic component to be mounted. Specifically, the restriction on size is also present in a wireless communication module. As for "thinness", a wireless communication module is desired to be less than 1 mm in height, for example. Note that the restriction on size (height and thickness) is not limitedly present only when mounting a wireless communication module on a compact portable terminal such as a smartphone, but also present when applying a wireless communication module to various devices.

In other words, in the wireless communication module 100 (module casing 101) illustrated in FIG. 1, a length L, a thickness (height) T, and a width are all 10 mm or greater. In addition, the open end 109 of the horn antenna 105 may conceivably be arranged on a side face of the module casing 101, for example. However, this arrangement expects a thickness T of the module casing 101 to be greater than the width D of the open end 109, and hence, it is difficult to achieve a size of 1 mm or less. Thus, in order to mount the wireless communication module 100 illustrated in FIG. 1 on a compact portable terminal such as a smartphone, a shape of the smartphone or the like is changed, for example. This results in, for example, forming the smartphone in a thicker shape, which leads to an adverse effect of impairing design flexibility.

Figure 2:
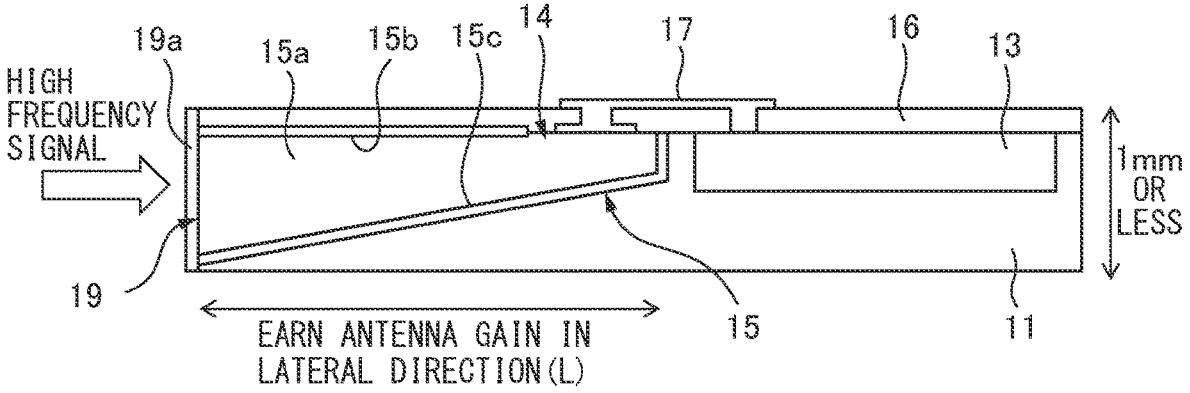
FIG. 2 is a diagram schematically illustrating a first example of a wireless communication module.

In the following, embodiments of a wireless communication module and a method of manufacturing the wireless communication module are described in detail with reference to the accompanying drawings. FIG. 2 is a diagram schematically illustrating a first example of a wireless communication module, and illustrates a wireless communication module that is applied to a wireless communication device, a radar device, an imaging device and the like using a high frequency signal in a millimeter wave band or higher.

In FIG. 2, reference numeral 1 depicts a wireless communication module, 11 depicts a mold resin, 13 depicts a semiconductor chip (MMIC), 14 depicts an antenna conversion unit, 15 depicts a horn antenna (waveguide horn antenna), 15*a* depicts a dielectric material, and 15*b* and 15*c* each depict a side face part. Further, reference numeral 16 depicts an insulating film, 17 depicts a transmission line (microstrip line), 19 depicts an open end, and 19*a* depicts an anti-reflective coating.

As illustrated in FIG. 2, the wireless communication module 1 according to the first example includes the horn antenna 15 and the semiconductor chip 13 that are integrally formed by the mold resin 11 by applying a Fan-Out Wafer Level Package (FO-WLP) technology, for example. In other words, the horn antenna 15 and the semiconductor chip 13 are embedded in the mold resin 11 by the FO-WLP, and the horn antenna 15 and the semiconductor chip 13 are connected through the microstrip line 17 by redistribution layer (RDL). Note that the RDL by the FO-WLP is used not only in the microstrip line 17, but also in, for example, an RDL grounding metal (for example, a GND metal 17' in FIG. 7A).

The horn antenna 15 includes the open end 19 provided on a longitudinal end face of the wireless communication module 1, and the antenna conversion unit 14 located on an opposite side of the open end 19 and connected with the semiconductor chip 13 through the microstrip line 17. Further, the horn antenna 15 includes the side face parts 15*b* and 15*c* whose shape is varied in a thickness direction of the wireless communication module 1 in a manner such that an opening area is widened from the antenna conversion unit 14 toward the open end 19.

The open end 19 of the horn antenna 15 can be formed in, for example, a rectangular shape. In other words, a side face part (side face parts 15*d* and 15*e* in FIG. 5) of the horn antenna 15 is preferably formed in such a shape that an opening area is widened from the antenna conversion unit 14 toward the open end 19 in a width direction of the wireless communication module 1.

Further, an upper face (first side face) 15*b*, a lower face (second side face) 15*c*, a left face (third side face 15*d*), and a right face (fourth side face 15*e*) of the dielectric material 15*a* in the horn antenna 15 are preferably metalized (coated with metal) except for the antenna conversion unit 14 and the open end 19. However, even without metal coating on all of the first to fourth side faces, the horn antenna 15 functions enough as an antenna owing to a dielectric confinement effect, for example.

Inside the horn antenna 15, the dielectric material 15*a* having a large permittivity (relative permittivity) is filled, and a thickness of the wireless communication module 1 is suppressed to be 1 mm or less, for example. Note that alumina ceramics, high-resistivity silicon, quartz, sapphire, an organic material such as High Density Polyethylene (HDPE) and the like can be used as the dielectric material 15*a*, for example.

In addition, the open end 19 of the horn antenna 15 is a face parallel with the longitudinal end face of the wireless communication module 1, and the anti-reflective coating layer 19*a* is provided to the open end 19. Note that a material of the anti-reflective coating layer 19*a* has a permittivity intermediate between a permittivity of air through which a high frequency signal that the wireless communication module 1 uses is transmitted and the permittivity of the dielectric material 15*a* filled inside the horn antenna 15, for example. Specifically, Parylene-C, Parylene-D, Silicon Dioxide ($SiO_2$), Graphene, and the like can be used as a material of the anti-reflective coating layer 19*a*.

The antenna conversion unit 14 includes, for example, a dielectric waveguide where the upper face 15*b* and the lower face 15*c* of the dielectric material 15*a* in the horn antenna 15 are metalized, and the microstrip line 17 that sets a ground potential GND to the same plane as the metalized upper face 15*b*. In addition, the semiconductor chip 13 can be electrically connected above the antenna conversion unit 14 of the horn antenna 15 through a via (a connection via 18 in FIG. 7A) and the microstrip line 17, for example. Note that the GND metal around the connection via 18 is provided with a hole for electrical insulation from a signal line. The hole is preferably formed as a hole of a size equal to or less than half a wavelength of a desired signal (high frequency signal) to be applied in the microstrip line 17, for example.

In this manner, the wireless communication module according to the first example becomes able to be formed thin (for example, as thin as 1 mm or less) while suppressing a signal loss between the horn antenna 15 and the semiconductor chip 13. In addition, since the horn antenna 15 can be formed as an end-fire antenna in which a feed node is arranged on a proximal end face portion of the semiconductor chip 13 or in the vicinity thereof, it is possible to earn an antenna gain in a lateral direction (longitudinal direction) without increasing a thickness. Further, by filling the dielectric material 15*a* inside the horn antenna 15, it is possible to implement a compact, yet high-gain antenna owing to a wavelength shortening effect.

Figure 3:
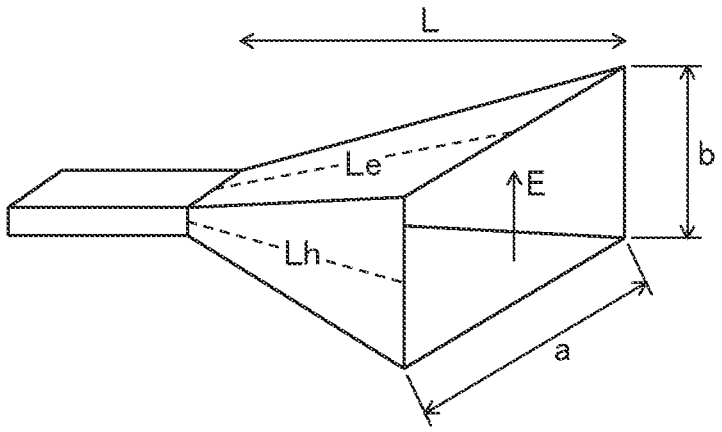
FIG. 3 is a diagram for describing a horn antenna of the wireless communication module illustrated in FIG. 2.

FIG. 3 is a diagram for describing the horn antenna of the wireless communication module illustrated in FIG. 2, and describes a general idea of a pyramidal horn antenna. When a flare length L (Lh, Le) of a horn is fixed and an aperture dimension is varied, a gain has a local maximum. Note that a horn that gives a maximum gain is called an optimum horn.

Phase shifts in an aperture (open end 19) of the optimum horn are a ⅜ wavelength and a ¼ wavelength in H-plane (Z=0 plane) and E-plane (Y=0 plane), respectively, and a size of the optimum horn (lengths of a and b) can be expressed by the following equations, where λ depicts a wavelength.

$$a=(3Lh\lambda)^{1/2}$$

$$b=(2Le\lambda)^{1/2}$$

Figure 4:
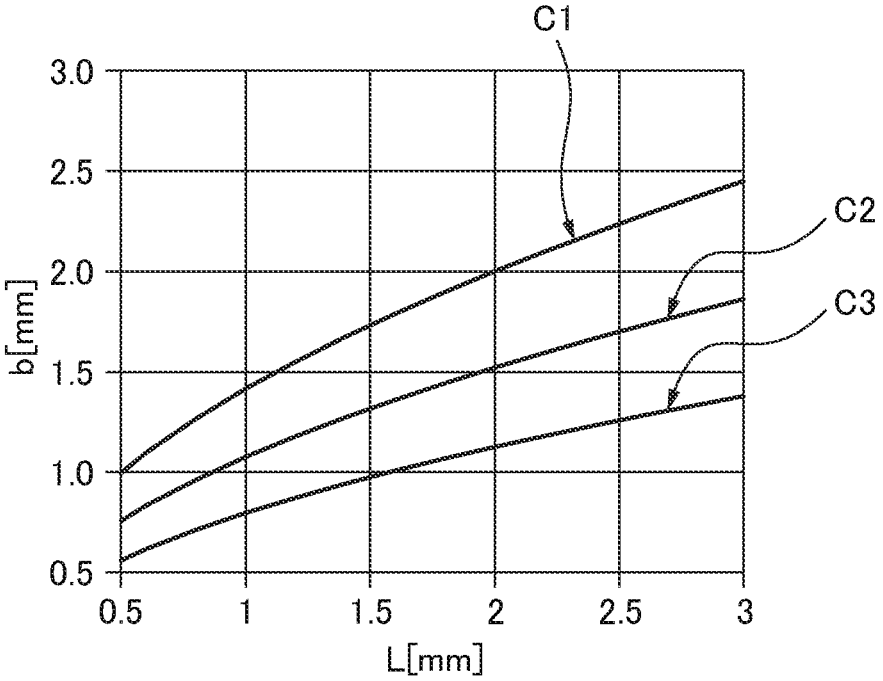
FIG. 4 is a diagram for describing a relation between a dimension of the horn antenna of the wireless communication module illustrated in FIG. 2 and a dielectric inside the horn antenna.

Based on the equations above, a relation between the height-direction size b and the flare length L in E-plane of the optimum horn in consideration of the wavelength in the dielectric is illustrated in FIG. 4. In other words, FIG. 4 is a diagram for describing a relation between a dimension of the horn antenna of the wireless communication module illustrated in FIG. 2 and the dielectric inside the horn antenna.

In FIG. 4, a vertical axis (b) is equivalent to the height-direction size of the open end 19 of the horn antenna 15 (the thickness of the wireless communication module 1), and a horizontal axis (L) is equivalent to the length of the horn antenna 15. In addition, in FIG. 4, a characteristic curved line C1 indicates when the dielectric material 15*a* filled inside the horn antenna 15 has a relative permittivity εr=1 (when the dielectric inside the horn antenna 15 is absent), C2 indicates when εr=3, and C3 indicates when εr=10. Note that a wavelength of a high frequency signal used is 1 mm (frequency of 300 GHz).

As illustrated by the characteristic curved line C1 in FIG. 4, since the relative permittivity is εr=1 when the dielectric inside the horn antenna 15 is absent (when the dielectric material 15*a* is air or vacuum), a horn flare L of longer than 0.5 mm results in a height b exceeding 1 mm, for example. In other words, in order to achieve the thickness (b) of the wireless communication module 1 to be 1 mm or less, the length (L) of the horn antenna 15 is desired to be formed to be shorter than 0.5 mm, which results in difficulty in earning a sufficient gain.

In contrast, as illustrated by the characteristic curved line C3 in FIG. 4, it can be understood that, when εr=10 (for example, the dielectric material 15*a* filled inside the horn antenna 15 is alumina ceramics or the like), even a horn flare L of 1.5 mm does not give a height b exceeding 1 mm. Accordingly, it is possible to achieve the thickness (b) of the wireless communication module 1 to be 1 mm or less while earning a sufficient gain. Note that, as illustrated by the characteristic curved line C2 in FIG. 4, when εr=3, a characteristic between the characteristic curved lines C1 and C3 can be obtained. As described above, besides alumina ceramics, high-resistivity silicon, quartz, sapphire, an organic material such as HDPE and the like can be used as the dielectric material 15*a* to be filled inside the horn antenna 15.

Figure 5:
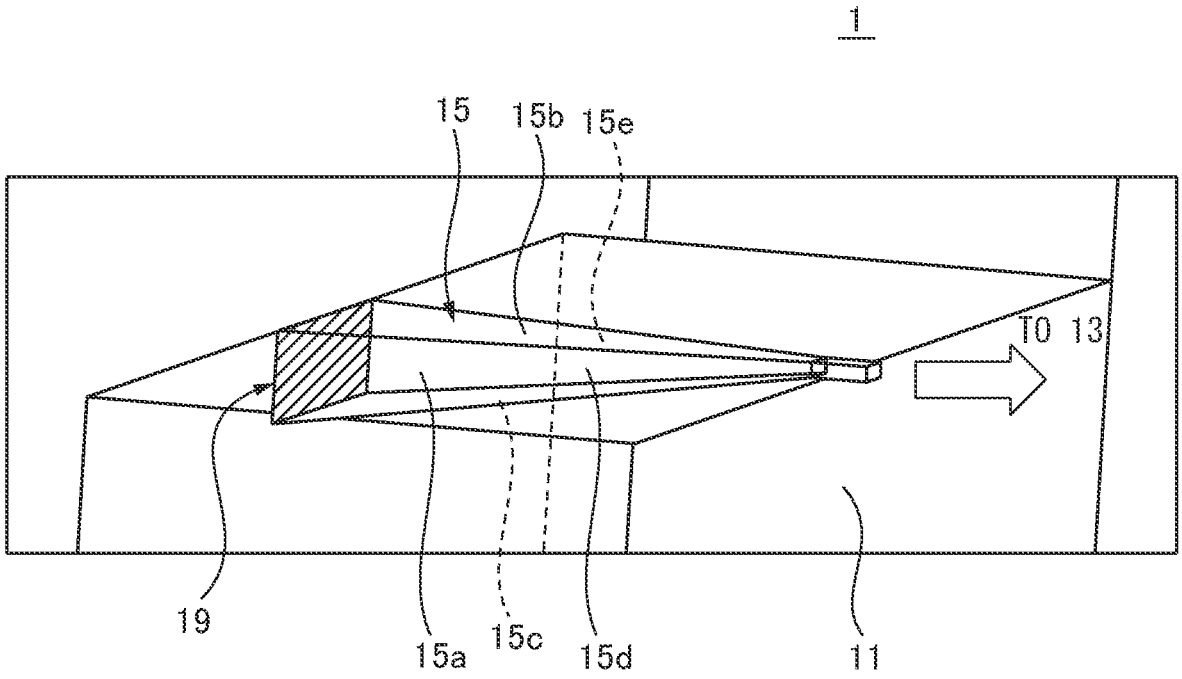
FIG. 5 is a diagram (no. 1) for describing a simulation of a horn antenna in an embodiment of a wireless communication module.
Figure 6A:
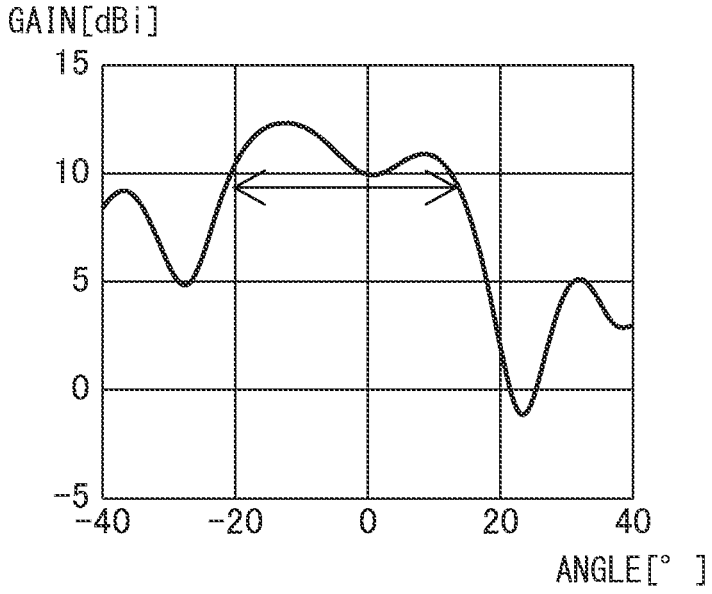
FIG. 6A and FIG. 6B each are a diagram (no. 2) for describing a simulation of a horn antenna in an embodiment of a wireless communication module.
Figure 6B:
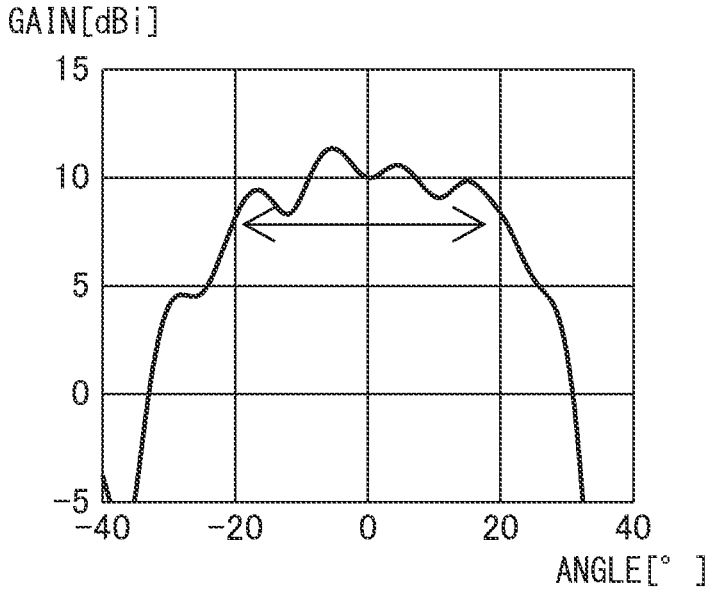

FIG. 5, FIG. 6A and FIG. 6B each are a diagram for describing a simulation of a horn antenna in an embodiment of a wireless communication module. FIG. 5 illustrates the simulated horn antenna 15, FIG. 6A illustrates a relation between an angle and a gain of the antenna in E-plane, and FIG. 6B illustrates a relation between an angle and a gain of the antenna in H-plane.

Note that the horn antenna 15, although being different from the optimum horn, has the open end 19 whose width a (width direction)× height b (thickness direction) is 2 mm×0.5 mm, has a length L of L=3 mm, and has the dielectric material 15*a* made of alumina ceramics. In addition, the horn antenna 15 has metal layers only on the upper face 15*b* and the lower face 15*c* thereof, with the left face 15*d* and the right face 15*e* being in contact with the mold resin 11. Further, a high frequency signal having a wavelength of 1 mm, in other words, having a frequency of 300 GHz is used.

As illustrated in FIG. 6A, it can be understood that a gain of 10 dBi or greater can be earned in E-plane (Y=0 plane) across a wide-angle range, for example, an angle range of 30° (±15°). In addition, as illustrated in FIG. 6B, it can be understood that a gain of 7 dBi or greater can be earned in H-plane (Z=0 plane) across a wide-angle range, for example, an angle range of 40° (±20°). In other words, the wireless communication module 1 illustrated in FIG. 5 is capable of earning a high gain while achieving a thickness of 1 mm or less (achieving the height of the open end 19 of the horn antenna 15 to be 0.5 mm).

Figure 7A:
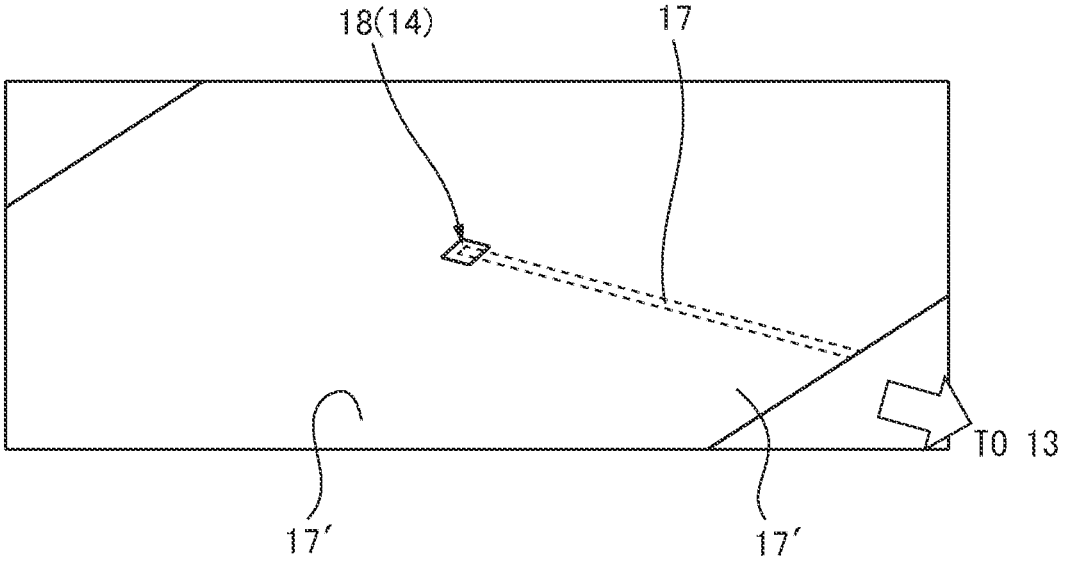
FIG. 7A and FIG. 7B each are a diagram (no. 1) for describing a simulation of an interlayer connection in redistribution layer in an embodiment of a wireless communication module.
Figure 7B:
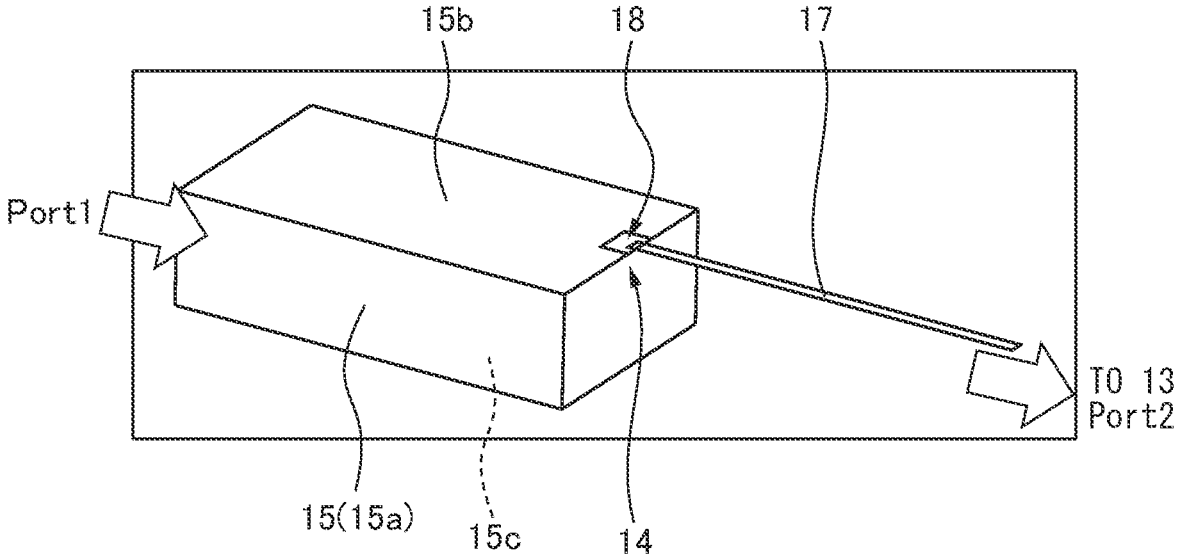
Figure 8:
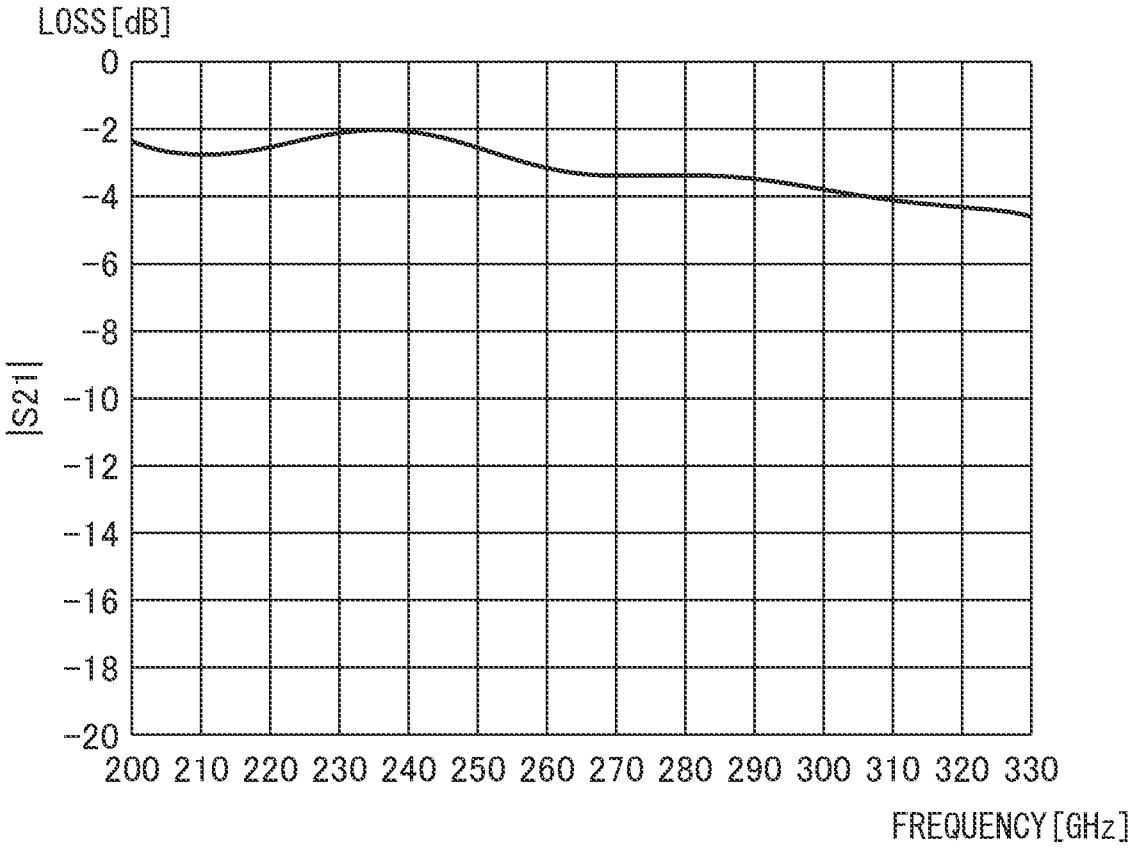
FIG. 8 is a diagram (no. 2) for describing a simulation of an interlayer connection in redistribution layer in an embodiment of a wireless communication module.

FIG. 7A, FIG. 7B and FIG. 8 each are a diagram for describing a simulation of an interlayer connection in redistribution layer in an embodiment of a wireless communication module. FIG. 7A and FIG. 7B each illustrate the antenna conversion unit 14 of the horn antenna 15 and the transmission line (microstrip line) 17, and FIG. 8 illustrates a frequency characteristic of an insertion loss. Note that FIG. 7B draws the horn antenna 15 (dielectric material 15*a*) below the GND metal 17' in FIG. 7A by seeing through (omitting) the GND metal 17'. In addition, FIG. 8 illustrates a change (loss) of an S-parameter (S21) with respect to a signal of 200 GHz to 330 GHz when electric power from a horn antenna 15 side (Port 2) propagates to a semiconductor chip 13 side (Port 1) via the antenna conversion unit 14 and the microstrip line 17.

As illustrated in FIG. 7A and FIG. 7B, in the interlayer connection in redistribution layer, for example, the grounding metal (GND metal) 17' formed by RDL (redistribution layer) is provided, and further, for example, a hole of 0.4 mm×0.4 mm is formed around the connection via 18 above the antenna conversion unit 14. Further, on the GND metal 17', for example, the microstrip line 17 of a predetermined width (for example, 20 μm) is formed with an insulating film such as polyimide having a film thickness of 10 μm being interposed. The antenna conversion unit 14 of the horn antenna 15 is so configured as to be connected to the semiconductor chip 13 through the connection via 18 and the microstrip line 17.

Note that a shape (cross-sectional shape) of the hole in the GND metal around the connection via 18 is not limited to a square of 0.4 mm×0.4 mm, but may be a circle or the like, for example. However, the hole is preferably formed as a hole of a size equal to or less than half a wavelength of a high frequency signal to be applied. In other words, since a wavelength of a high frequency signal to be applied in the simulation is 1 mm, a square hole having a cross-sectional shape of 0.4 mm×0.4 mm is applied as the connection via 18. In addition, a portion of the alumina waveguide 15 (a portion corresponding to the antenna conversion unit 14 of the horn antenna 15 in which the dielectric material 15*a* is filled) in FIG. 7B has a cross-sectional shape of 0.136 mm×0.276 mm, and the upper face 15*b* and the lower face 15*c* are metalized.

As illustrated in FIG. 8, it can be understood that the interlayer connection in redistribution layer illustrated in FIG. 7A and FIG. 7B is capable of suppressing a loss to be less than −4 dB across a bandwidth of 100 GHz or greater (for example, from 200 GHz to 300 GHz, or from 210 GHz to 310 GHz). In other words, the interlayer connection in redistribution layer illustrated in FIG. 7A and FIG. 7B is effective as a converter (antenna conversion unit 14) that converts a propagation mode from a signal for the dielectric waveguide (alumina waveguide 15) where the upper face 15*b* and the lower face 15*c* are metalized to a signal for the microstrip line 17. In addition, the interlayer connection in redistribution layer illustrated in FIG. 7A and FIG. 7B is of low loss, such as −4 dB across a wide bandwidth of 100 GHz or greater, and thus is applicable to broadband applications.

As described above, the wireless communication module 1 according to the first example is able to be manufactured with low loss and good reproducibility, since the horn antenna 15 and the semiconductor chip (MMIC) 13 are connected through the microstrip line 17 (RDL). The wireless communication module 1 according to the first example is able to be formed thin while suppressing a signal loss between the horn antenna and the semiconductor chip. The configurations and advantageous effects described above in detail will be the same in a second example described below.

Figure 9:
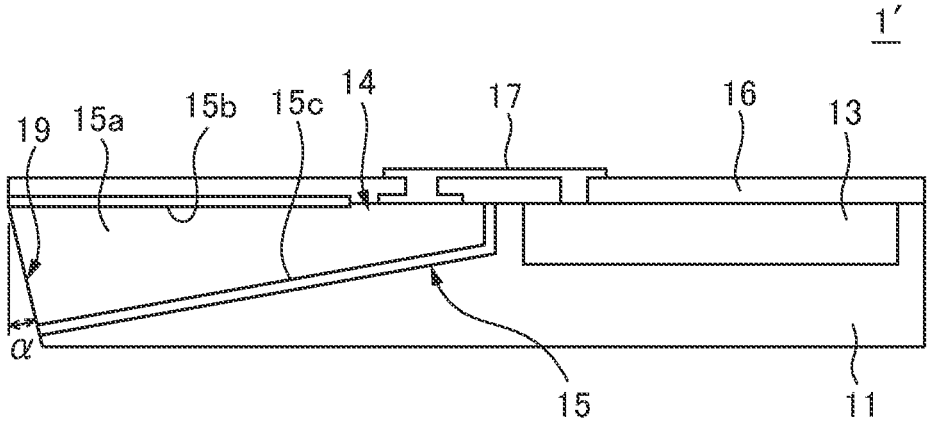
FIG. 9 is a diagram schematically illustrating a second example of a wireless communication module.

FIG. 9 is a diagram schematically illustrating a second example of a wireless communication module. As is clear from comparison between FIG. 9 and FIG. 2 described above, a wireless communication module 1' according to the second example includes the open end 19 of the horn antenna 15 that is cut at a predetermined angle α.

In other words, the aperture of the open end 19 is cut along a face forming the angle α with a longitudinal end face of the wireless communication module 1', so that the upper face 15*b* and the lower face 15*c* of the horn antenna 15 are formed symmetric to each other. In other words, the horn antenna 15 is so configured as to be capable of symmetrically controlling antenna directivity by aligning the shape thereof. Note that it is possible to cut the open end 19 at a predetermined angle by using, for example, a grinding machine. In addition, it is needless to say that the anti-reflective coating layer 19*a* can be provided to the open end 19 of the horn antenna 15 in the same manner as in the first example described with reference to FIG. 2.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

What is claimed is:

1. A wireless communication module comprising:

a horn antenna and a semiconductor chip, wherein the horn antenna and the semiconductor chip are integrally formed by a mold resin and are connected through a transmission line, and the horn antenna includes:

an open end provided on a longitudinal end face of the wireless communication module;

an antenna conversion unit located on an opposite side of the open end and connected with the semiconductor chip through the transmission line; and a side face part whose shape is varied in a thickness direction of the wireless communication module corresponding to a height direction of the open end of the horn antenna in a manner such that an opening area is widened from the antenna conversion unit toward the open end, wherein a dielectric material is filled inside the horn antenna, the open end of the horn antenna is in a rectangular shape, and the side face part of the horn antenna includes:

a first side face and a second side face whose length in the thickness direction of the wireless communication module is varied in a manner such that an opening area is widened from the antenna conversion unit toward the open end; and a third side face and a fourth side face whose length in a width direction of the wireless communication module is varied in a manner such that an opening area is widened from the antenna conversion unit toward the open end, and wherein at least one of the first side face, the second side face, the third side face and the fourth side face is metalized, the antenna conversion unit includes:

a dielectric waveguide where the first side face and the second side face of the dielectric material in the horn antenna are metalized; and a grounding metal of a ground potential provided on the first side face of the dielectric waveguide, and a connection via that connects the dielectric waveguide to the transmission line provided on the grounding metal with an insulating film being interposed.

2. The wireless communication module according to claim 1, wherein the side face part of the horn antenna is formed in such a shape that an opening area is widened from the antenna conversion unit toward the open end in a width direction of the wireless communication module.

3. The wireless communication module according to claim 1, wherein an aperture at the open end of the horn antenna is a face parallel with the longitudinal end face of the wireless communication module or a face cut at a predetermined angle.

4. The wireless communication module according to claim 1, wherein an anti-reflective coating layer is provided to the open end of the horn antenna.

5. The wireless communication module according to claim 1, wherein a hole to be bored through a GND metal around the connection via is formed as a hole of a size equal to or less than half a wavelength of a signal to be applied.

6. The wireless communication module according to claim 1, wherein the integral formation of the horn antenna and the semiconductor chip by the mold resin is performed by Fan-Out Wafer Level Package, and the connection of the horn antenna and the semiconductor chip through the transmission line is performed by redistribution layer in the Fan-Out Wafer Level Package.

7. A method of manufacturing a wireless communication module comprising:

preparing a horn antenna and a semiconductor chip;

integrally forming the horn antenna and the semiconductor chip by a mold resin; and connecting the horn antenna and the semiconductor chip through a transmission line, wherein the horn antenna includes:

an open end provided on a longitudinal end face of the wireless communication module;

an antenna conversion unit located on an opposite side of the open end and connected with the semiconductor chip through the transmission line; and a side face part whose shape is varied in a thickness direction of the wireless communication module corresponding to a height direction of the open end of the horn antenna in a manner such that an opening area is widened from the antenna conversion unit toward the open end, wherein a dielectric material is filled inside the horn antenna the open end of the horn antenna is in a rectangular shape, and the side face part of the horn antenna includes:

a first side face and a second side face whose length in the thickness direction of the wireless communication module is varied in a manner such that an opening area is widened from the antenna conversion unit toward the open end; and a third side face and a fourth side face whose length in a width direction of the wireless communication module is varied in a manner such that an opening area is widened from the antenna conversion unit toward the open end, and wherein at least one of the first side face, the second side face, the third side face and the fourth side face is metalized the antenna conversion unit includes:

a dielectric waveguide where the first side face and the second side face of the dielectric material in the horn antenna are metalized; and a grounding metal of a ground potential provided on the first side face of the dielectric waveguide, and a connection via provided on the grounding metal with an insulating film being interposed, and wherein the dielectric waveguide is connected to the transmission line through the connection via.

8. The method of manufacturing the wireless communication module according to claim 7, wherein an anti-reflective coating layer is formed to the open end of the horn antenna.

9. The method of manufacturing the wireless communication module according to claim 7, wherein the connection via is formed as a hole of a size equal to or less than half a wavelength of a signal to be applied.

10. The method of manufacturing the wireless communication module according to claim 7, wherein the integral formation of the horn antenna and the semiconductor chip by the mold resin is performed by Fan-Out Wafer Level Package, and the connection of the horn antenna and the semiconductor chip through the transmission line is performed by redistribution layer in the Fan-Out Wafer Level Package.

* * * * *